US005218748A

United States Patent [19]

Tanaka et al.

[11] Patent Number: 5,218,748

[45] Date of Patent: Jun. 15, 1993

[54] METHOD FOR EXCHANGING PACKAGES ON A TEXTILE MACHINE

[75] Inventors: Masayoshi Tanaka, Kanazawa; Maki Miyamoto, Ishikawa, both of Japan

[73] Assignees: Tsudakoma Kogyo Kabushiki Kaisha; Kabushiki Kaisha Kaji Seisakusho, Japan

[21] Appl. No.: 846,878

[22] Filed: Mar. 6, 1992

[30] Foreign Application Priority Data

Mar. 6, 1991 [JP] Japan ..... 3-068061

[51] Int. Cl.[5] ..... B65H 67/00; B65H 49/02

[52] U.S. Cl. ..... 28/193; 28/201; 242/131; 242/131.1; 414/908; 414/910

[58] Field of Search ..... 28/193, 289, 290, 191, 28/201; 242/131, 131.1; 414/908, 910, 758, 773, 911, 786

[56] References Cited

U.S. PATENT DOCUMENTS

| | | | |
|---|---|---|---|
| 3,753,274 | 8/1973 | Koslowski | 28/193 |
| 3,915,406 | 10/1975 | Rolli et al. | 242/131 |
| 4,515,328 | 5/1985 | Payne, Jr. | 242/131.1 |
| 4,629,143 | 12/1986 | Griffin | 414/911 X |
| 4,669,942 | 6/1987 | Nagasawa | 242/35.5 |
| 4,768,734 | 9/1988 | Küsters | 28/193 X |
| 4,783,021 | 11/1988 | Nagasawa | 242/131.1 |
| 4,988,252 | 1/1991 | Yamamoto et al. | 242/35.5 |
| 5,012,564 | 5/1991 | Giron et al. | 28/193 |

*Primary Examiner*—Clifford D. Crowder
*Assistant Examiner*—Bibhu Mohanty
*Attorney, Agent, or Firm*—Lerner, David, Littenberg, Krumholz & Mentlik

[57] ABSTRACT

In a system for exchanging packages on a textile machine such as a rewinder, a creel loader receives empty packages from a creel for transportation to the position of a package supporter, the package supporter is rotated about a vertical axis over 180 degrees to place full packages in a position facing the creel loader, and, after receipt of the full packages, the creel loader travels to a section of the creel in need of package exchange for transfer of the full packages to the creel. Concurrently with this process, full packages from a package stocker is mounted to the package supporter by operation of an assistant device such as a robot for next exchange of packages with the creel loader. Loss in production efficiency otherwise caused by empty travel of the loader is well avoided. A package holder includes a bracket driven for 180 degree rotation about a horizontal axis, and a pair of parallel, cooperating support shafts are secured to the bracket with an intervening distance greater than the diameter of a peg cooperating with the package holder, and each support shaft carries a pair of radial support arms. Loss in production efficiency otherwise caused by shift in package lot is well reduced.

1 Claim, 9 Drawing Sheets

METHOD FOR EXCHANGING PACKAGES ON A TEXTILE MACHINE

BACKGROUND OF THE INVENTION

The present invention relates to method for exchanging packages on a textile machine and a package holder used therefor, and more particularly relates to improvements in exchange of empty and full packages such as bobbins and pans on a textile machine such as a winder and a warp sizing machines.

Packages are mounted to pegs arranged in a substantially horizontal state on a creel of a textile machine and, when the packages on the creel become empty during operation of the textile machine, empty packages are exchanged with full packages by assistance of a creel loader which holds the full packages in a substantially horizontal state.

In general, packages are mounted to a package stocker with its tube in a vertical position. At transfer of packages from the package stocker to a creel loader, it is highly difficult to hold the packages in a horizontal state without any contact with yarns on the packages because of the large weight of the packages. For this operational reason, the packages are once transferred provisionally to a package supporter from the package stocker in a hanging state and placed vertically thereon prior to mounting to the package loader.

The package supporter is provided with a package support frame which contained a number of pegs secured on its one face in a vertical arrangement. For provisional placement of the packages, the support frame is rotated about a horizontal axis into a horizontal position. Next, the support frame is rotates about the horizontal axis into a vertical position so as to hold the packages in a horizontal state. In this horizontal state, the packages are transferred from the package supporter to the creel loader for transportation to the creel. In this case a number of packages are concurrently transferred together.

More specifically, a creel loader comes to one section of a creel to receive empty packages mounted thereon and travels to the position of a package supporter. Upon arrival at the position, the creel loader transfers the empty packages to pegs on the package supporter and, thereafter, the creel loader travels to another section of the creel where empty packages are mounted. Concurrently with this process, the package supporter rotates about its horizontal axis for dismounting of the empty packages.

After complete dismounting of the empty packages, the package supporter again rotates in the opposite direction about its horizontal axis so as to be ready for next reception of empty packages from the creel loader. During this process, the creel loader receives empty packages from the creel.

When all of the empty packages have been dismounted from the creel via repetition of the above-described operations, the creel loader sequentially transports to the creel full packages provisionally placed on the package supporter from the package stocker.

Transportation of the full packages is carried out in the following sequence. First full packages are provisionally places on pegs on the package supporter support frame in a substantially horizontal position. By 90 degrees rotation the package support frame assumes a vertical position with the packages in a horizontal state.

In this state, the creel loader receives the full packages from the package supporter standing-by and travels to one section of the package where the full packages should be mounted. After mounting the full packages to pegs on the creel, the package loader in an empty state travels back to the position of the package supporter. Note that no packages are carried by the creel loader during this cycle of travel. Transfer of full packages is completed by repetition of the above-described operations.

From the foregoing, it is clear that, during one reciprocation of the package loader between the creel and the package supporter, the creel loader travels half of the reciprocation without transportation of any packages, i.e. in an empty condition.

At transfer of packages between the creel loader and the creel as well as between the creel loader and the package supporter, the packages are transferred between pegs on one side and package holders on the other side.

Packages are in general classified into two major groups, i.e. bobbins and pans which are different in size of tube for winding of yarns. That is, a bobbin requires a tube of a thick construction and a pan requires a tube of a thin construction. So, a package holder suited in dimension for the bobbin tube does not fit the pan tube whereas a package holder suited in dimension for the the pan tube does not fit the bobbin tube.

In an attempt to make up for this gap, it is conventionally employed in practice to support a thick tube from inside with one to two package holders and, for a thin tube, a separate package holder is provided to hold the same from outside. When this expedient is employed, every shift in type of tubes on creel side necessitates corresponding shift in package holders on the creel loader side. This inconvenience similarly occurs between the creel loader and the package supporter. Such frequent shifts in part specification results in great loss in labour and time, thereby seriously lowering production efficiency.

SUMMARY OF THE INVENTION

It is the primary object of the present invention to reduce the loss in production efficiency conventionally caused by empty travel of the creel loader between the creel and the package supporter in a package exchange system on a textile machine.

It is another object of the present invention to reduce the loss in production efficiency conventionally caused by shift in lot on process in a package exchange system on a textile machine.

In accordance with one aspect of the present invention, in method for exchanging packages on a textile machine in which an assistant device for displacing the packages in a substantially horizontal position, a package supporter equipped with support frame which is provided with a number of pegs on two parallel planes and rotatable about a vertical axis, and a creel loader reciprocal between a creel and the package supporter are used in combination, empty packages are transferred from the creel to the creel loader for transportation to the position of the package supporter by travel of the creel loader, the empty packages are transferred from the creel loader to one side of the supporter frame, the supporter frame is rotated about the vertical axis over 180 degrees to place full packages beforehand mounted on the other side of the support frame in position suited for subsequent transfer to the creel loader, the full packages are transported to the position of the creel by travel of the creel loader after the transfer, the full packages are transferred from the creel loader to the creel, the empty packages are dismounted from the package supporter by operation of the assistant device during transportation and transfer of the full packages and new full packages from a package stocker are mounted to the package supporter.

In accordance with another aspect of the present invention, in a package holder, a bracket is driven for rotation about a horizontal axis over 180 degrees, a pair of parallel support shafts are secured to the bracket whilst extending in the direction of the horizontal axis, the support shafts are spaced from each other by a distance greater than the diameter of a peg with which the package holder cooperates for the package transfer, and a pair of support arms are radially secured to each support shaft and spaced apart from each other in the direction of the horizontal axis.

DESCRIPTION OF THE PREFERRED EMBODIMENTS

Figure 1:
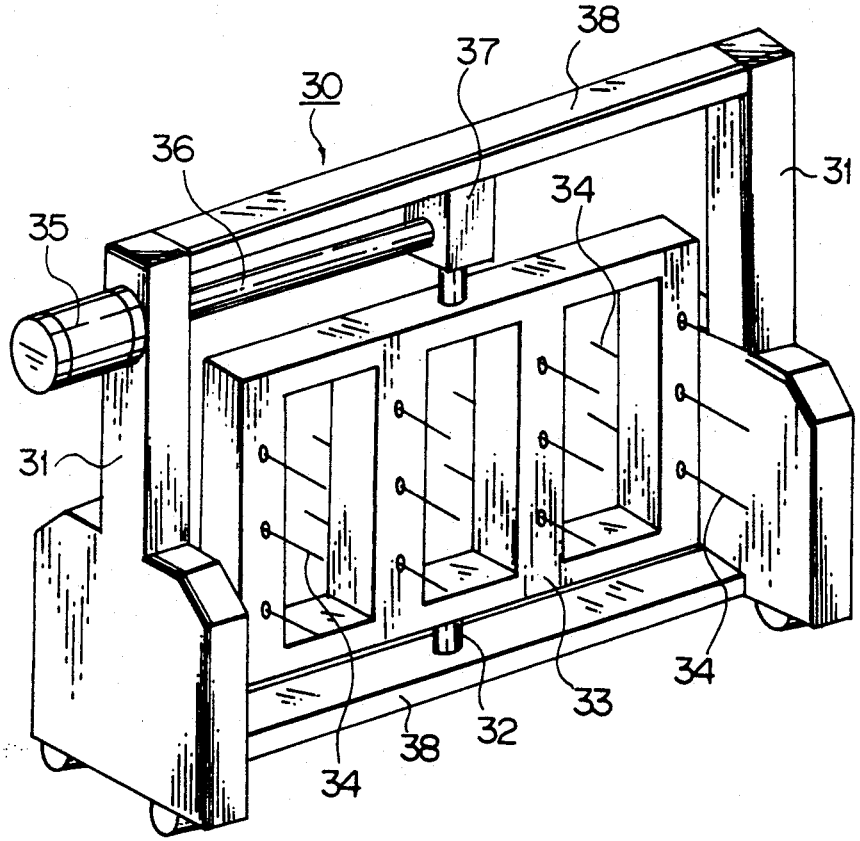
FIG. 1 is a perspective view of one example of the package supporter used for the present invention.

One example of the package supporter used for the present invention is shown in FIG. 1 in which the package supporter 30 includes a pair of stands 31 spanned by upper and lower horizontal beams 38. A drive motor 35 is mounted to one stand 31 and its drive shaft 36 extends horizontally in parallel to the upper beam 38 to a gear box 37 attached to the midway of the upper beam 38. A rotary shaft 32, which is mechanically coupled to the drive shaft 36 within the gear box 37, extends vertically with its lower end received in the lower beam 38. A substantially rectangular support frame 33 is coupled to the rotary shaft 32 whilst carrying a number of pegs 34 projecting in a horizontal direction on two parallel planes. Thus, when driven by the drive motor 35, the support frame 33 rotates with the rotary shaft 32 about a vertical axis located about the midway of the upper and lower beams 38.

The assistant device can be given in various forms. For full automation of the system, robots can be advantageously used and, when manual operation is partially utilized in the system, electric or pneumatic lifters can be used.

The operation of the system in accordance with the present invention will now be explained in sequence in reference to FIGS. 2A to 2H in which small white boxes indicate empty packages whereas small block boxes indicate full packages.

Figure 2A:
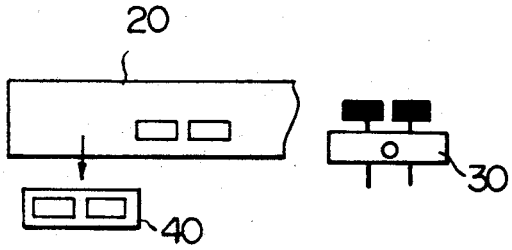
FIGS. 2A to 2H are plan views for showing operational steps in one embodiment of the method in accordance with the present invention.

First, as shown in FIG. 2A, a creel loader 40 comes to the position of a creel 20 in order to receive empty packages mounted thereon. During this process, new full packages are transferred to a package supporter 30 by operation of an assistant device now shown in the illustration.

Figure 2B:
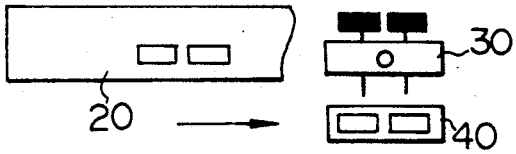
Figure 2C:
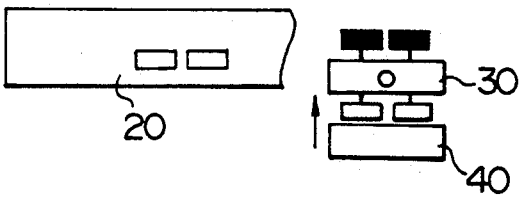
Figure 2D:
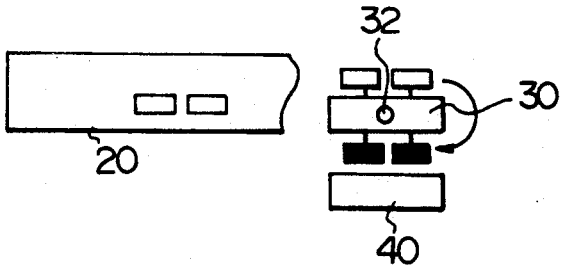

Next, as shown in FIG. 2B, the creel loader 40 travels to the position of the package supporter 30 for transfer of the empty packages to the package supporter 30. On arrival at the position of the package supporter 30 as shown in FIG. 2C, the empty packages are transferred from the creel loader 40 to the package supporter 30.

Figure 2E:
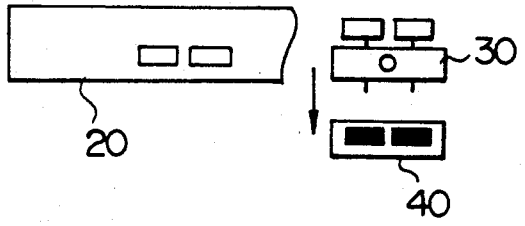
Figure 2F:
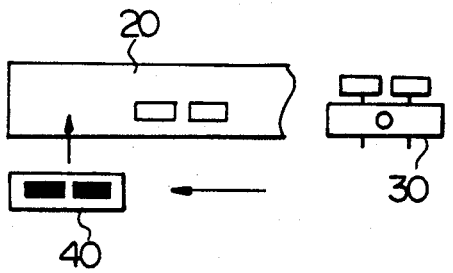

After complete transfer of the empty packages, the package supporter 30 perform 180 degree rotation about the vertical axis so as to place the full packages received from the package stocker in position facing the creel loader 40. Then, as shown in FIG. 2E, the creel loader 40 receives the full packages from the package supporter 30.

Figure 2G:
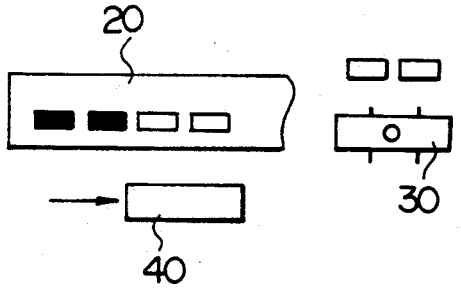
Figure 2H:
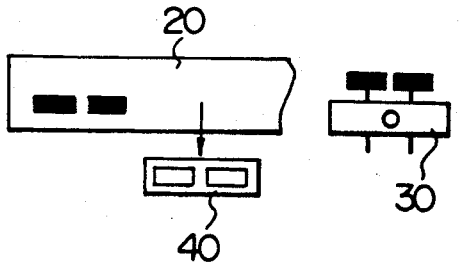

After complete transfer of the full packages, the creel loader 40 travels to the section of the creel 20 which is in need of new full packages. On arrival at the position of the section, the full packages are transferred from the creel loader 40 to the creel 20. Next, as shown in FIG. 2G, the creel loader 30 moves to an adjacent section of the creel 20 where empty packages are mounted. On arrival at the section, the empty packages are dismounted from the creel 20 to be transferred to the creel loader 40 as shown in FIG. 2H. During this process, the empty packages on the package supporter 30 are transferred to the package stocker by operation of the assistant device. The above-described operations are repeated for necessary cycles until all empty packages on the creel 20 are exchanged with full packages on the package supporter 30.

In the case of the illustrated example, exchange of packages is carried out on one side of the creel 20 only. Like exchange of packages can be carried out on both sides of the creel 20 also. In this case, two sets of creel loaders 40 are provided on both sides of the creel 20 in combination with one set of common package supporter 30.

When a plurality of creels 20 are arranged side by side, one creel loader 40 can perform exchange of packages on its both sides concurrently.

In accordance with the above-described method of the present invention, the creel loader 40 transports empty packages on its travel from the creel 20 to the package supporter 30 and full packages on its travel from the package supporter 30 to the creel 20. In other words, the creel loader 40 travels between the creel 20 and the package supporter 30 always with transportation of the packages and no empty travel is performed. Thanks to such a full utilization of the travel of the creel loader 40, exchange of packages can be carried out with high production efficiency.

For comparison purposes, exchange of packages in the conventional system will now be explained in detail in reference to FIG. 3A to 3F and FIG. 4A to 4D.

Figure 3A:
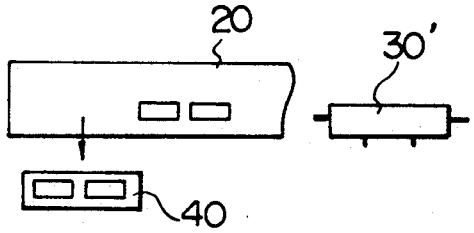
FIGS. 3A to 3F are plan views for showing operational steps in one example of a method for transferring empty packages by a conventional package supporter.
Figure 3B:
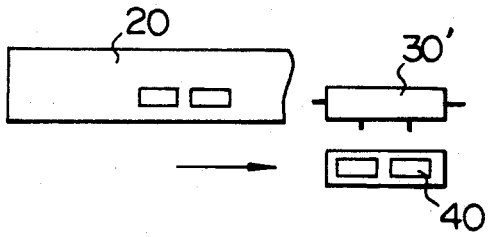
Figure 3C:
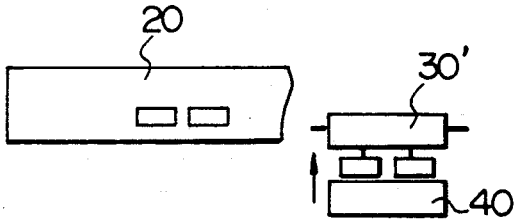
Figure 3D:
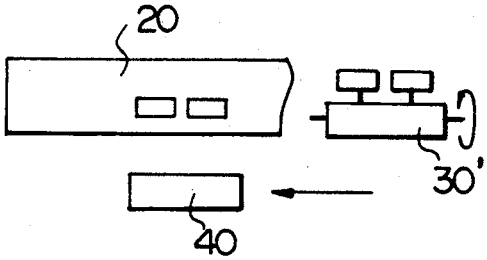
Figure 3E:
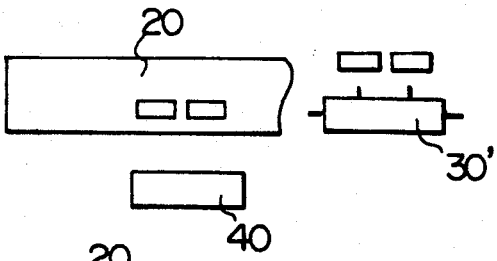
Figure 3F:
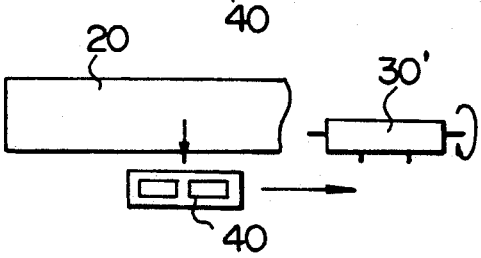

First, as shown in FIG. 3A, a creel loader 40 receives empty packages from a creels 20 and travels to the potion of a conventional package supporter 30' as shown in FIG. 3B. On arrival at the position, the empty packages are transferred to the package supporter 30' from the creel loader 40 as shown in FIG. 3 C. After complete transfer of the empty packages, the creel loader 40 travels to a section of the creel 20 which requires package exchange. Note that, during this travel, the creel loader 40 transports no packages. Concurrently with this process, the package supporter 30' rotates about its horizontal axis as shown in FIG. 3D and the empty packages are dismounted therefrom by operation of the assistant device. After complete dismounting, the package supporter 30' again rotate in a reverse direction about its horizontal axis for next receipt of new empty packages as shown in FIG. 3F. Like in FIG. 3A, the creel loader 40 receives new empty packages from the creel 20. This operation is repeated until all empty packages on the packages are exchanged.

Figure 4A:
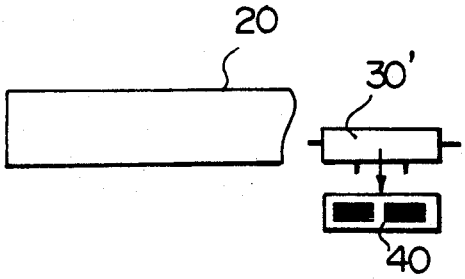
FIGS. 4A to 4D are plan views for showing operational steps in one example of a method for transferring full packages by a conventional package supporter.
Figure 4B:
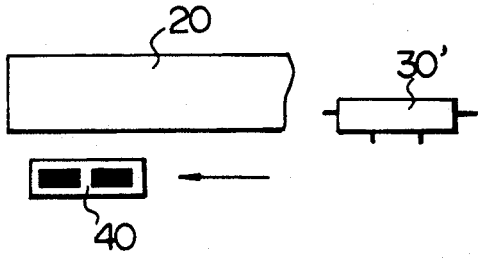
Figure 4C:
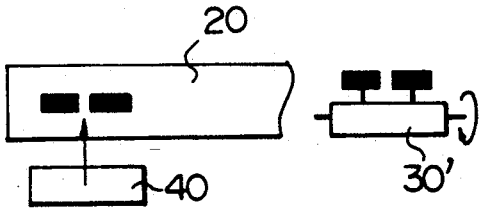
Figure 4D:
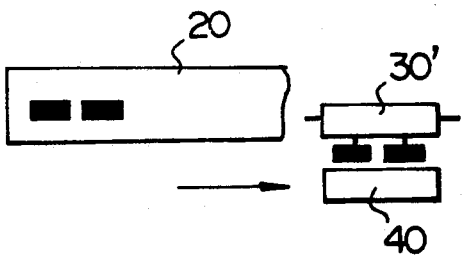

Next, full packages provisionally placed on the package supporter 30' have to be passed to the creel 20. As shown in FIG. 4A, the full packages on the package supporter 30' are transferred to the creel loader 40 which then travels towards the creel 20 as shown in FIG. 4B. On arrival at the section of the creel 20 which requires supply of the full packages, the full packages are transferred to pegs on the creel 20 from the creel loader 40 as shown in FIG. 4C. After complete transfer of the full packages, the creel loader 40 travels back to the position of the package supporter 30' without any packages on it. Note that the creel loader 40 again travels quite empty at this time. See the operational step shown in FIG. 3D.

Figure 5:
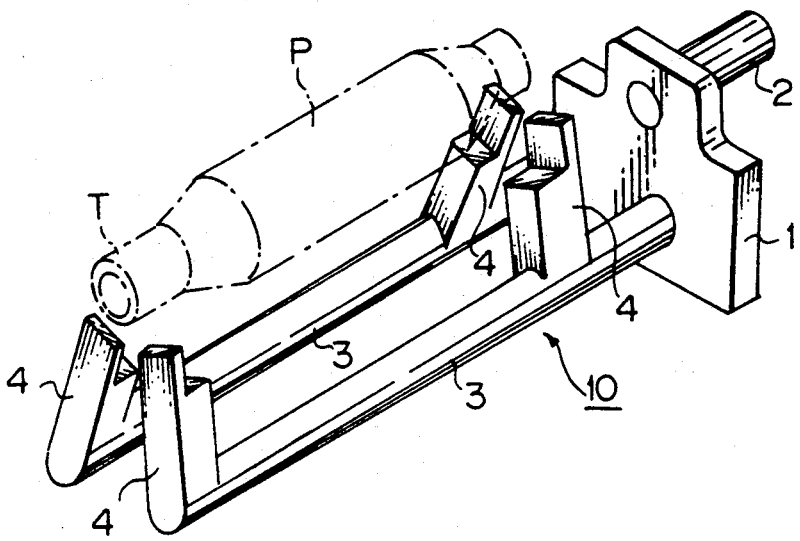
FIG. 5 is a perspective view of one embodiment of the package holder in accordance with the present invention, FIG. 6 a a perspective view of the package holder holding a bobbin.

One embodiment of the package holder in accordance with the present invention is shown in FIG. 5 in which the package holder 10 includes a plate shaped bracket 1 secured to one end of a horizontal rotary shaft 2. The rotary shaft 2 is operationally coupled to a proper known drive source such as a drive motor so as to rotate about a horizontal axis over 180 degrees. On the opposite side of the bracket 1 are secured a pair of support shafts 3 extending in the direction of the horizontal axis of rotation. The support shafts 3 are arranged in parallel to each other and spaced from each other by a distance greater than the diameter of a peg with which the package holder cooperates.

A pair of support arms extend radially from each support shaft 3 at positions near its distal and proximal ends. The support arms 4 are arranged so that distal ends of associated support arms 4 on different support shafts 3 are located closer to each other than their proximal ends.

In the position shown in FIG. 5, the package holder 10 is adapted for holding a pan P shown with chain lines. The support arms 4 are directed upwards. More specifically, the pair of support arms 4 on the distal side of the support shafts 4 cooperate to hold the distal end of the pan P whereas the pair of support arms 4 on the proximal sides of the support shafts 4 cooperate to hold the proximal end of the pan P.

Figure 6:
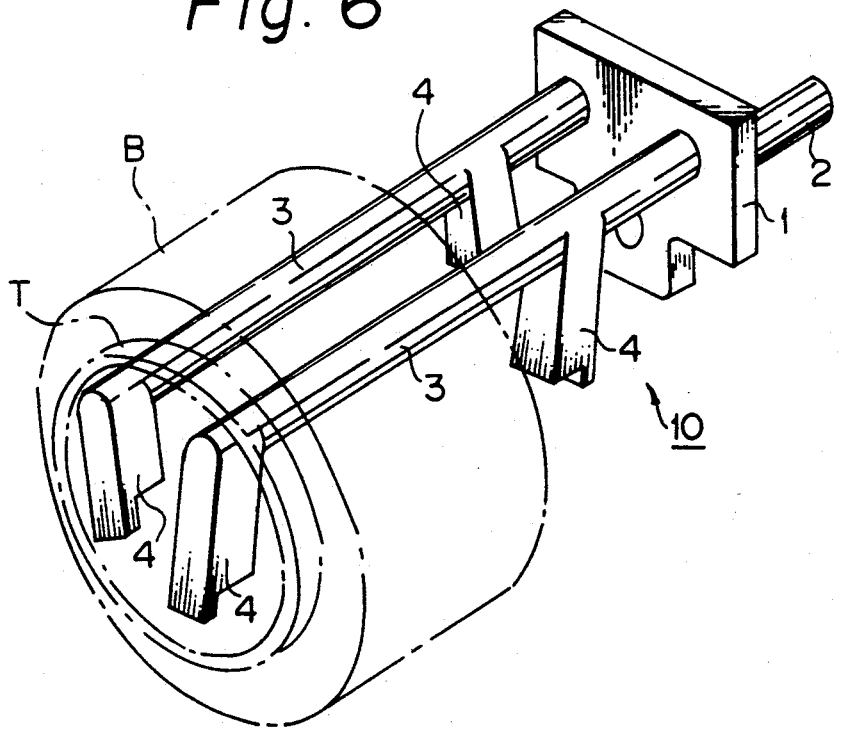

In the position shown in FIG. 6, the package holder 10 is adapted fro holding a bobbin B shown with chain lines. The support arms 4 are directed downwards. More specifically, the pair of support shafts 3 extend through the interior of the tube T of the bobbin B in contact with the inner periphery of the tube T.

Use in practice of the package holder in accordance with the present invention will now be explained in reference to FIGS. 7A to 7C, in which a pan P is to be transferred between the package holder 10 and a peg G on a creel.

Figure 7A:
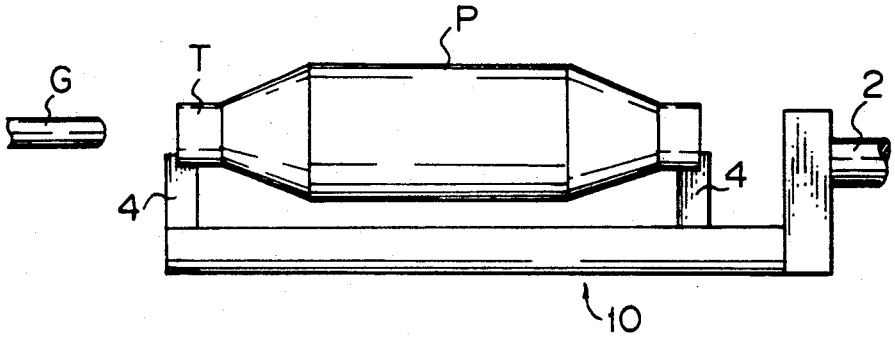
FIGS. 7A to 7C are side views, partly in section, for showing transfer of a pan by the package in accordance with the present invention.
Figure 7B:
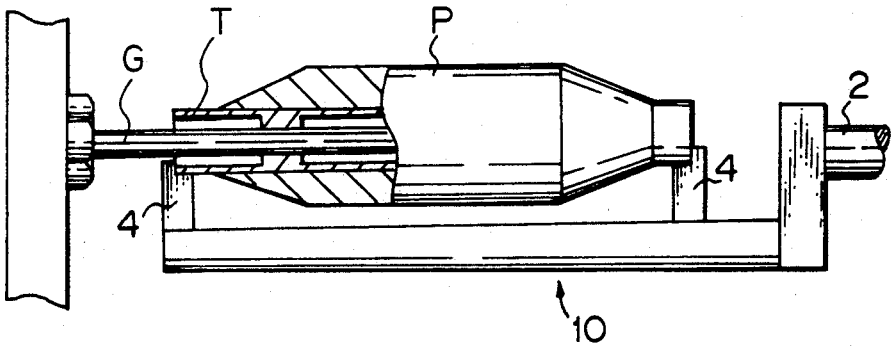
Figure 7C:
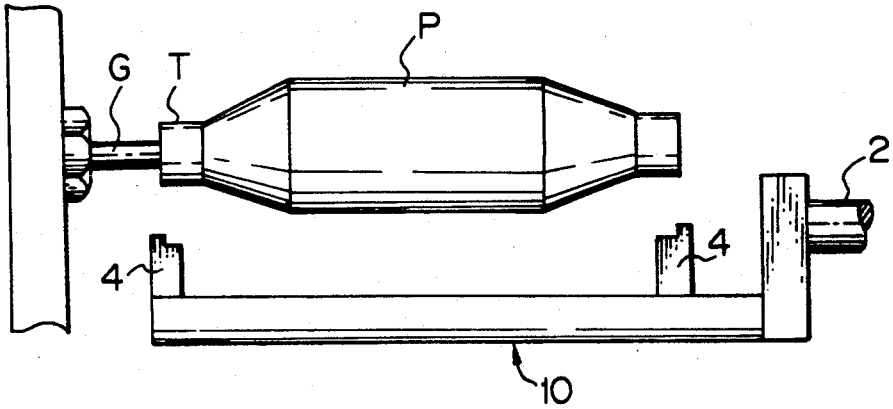
Figure 8:
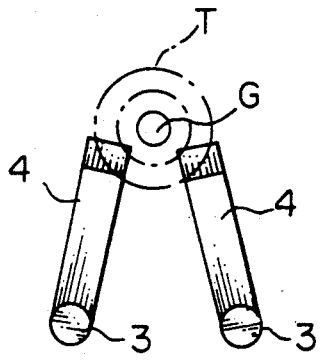
FIG. 8 is an end view of the package holder in accordance with the present invention in a condition holding a pan.

First, as shown in FIG. 7A, the package holder 10 travels to the position of the peg G on the creel whilst holding a pan P via its support arms 4. By further travel of the package holder 10, the peg G invade into the interior of the tube T of the pan P as shown in FIG. 7B. The relation in position between the support arms 4 and the peg G is shown in FIG. 8. After complete invasion of the peg G into the tube T, the package holder 10 moves downwards as shown in FIG. 7C and the pan P is now completely transferred to the peg G on the creel.

Figure 9A:
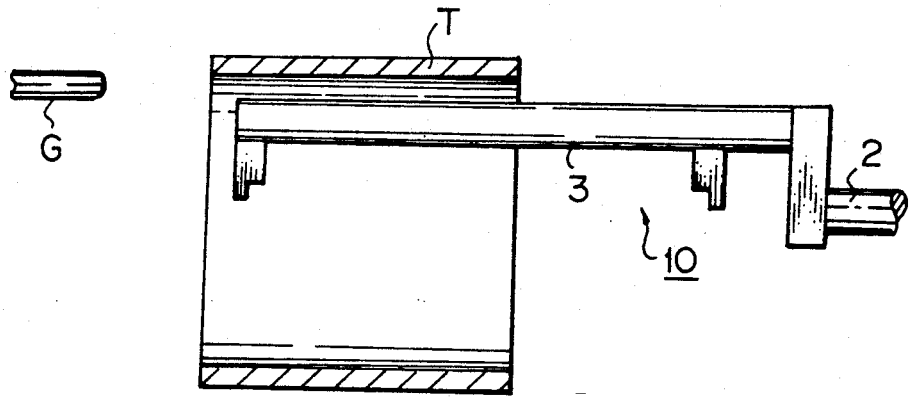
FIGS. 9A to 9C are side views, partly in section, for showing transfer of a bobbin by the package in accordance with the present invention.
Figure 9B:
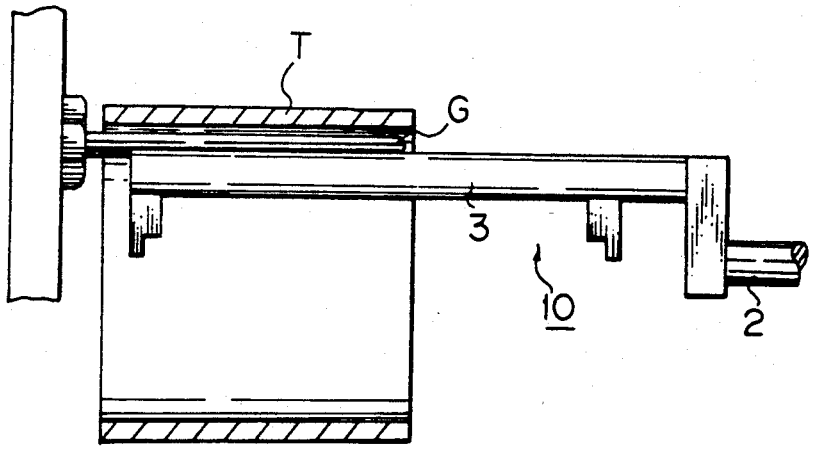
Figure 9C:
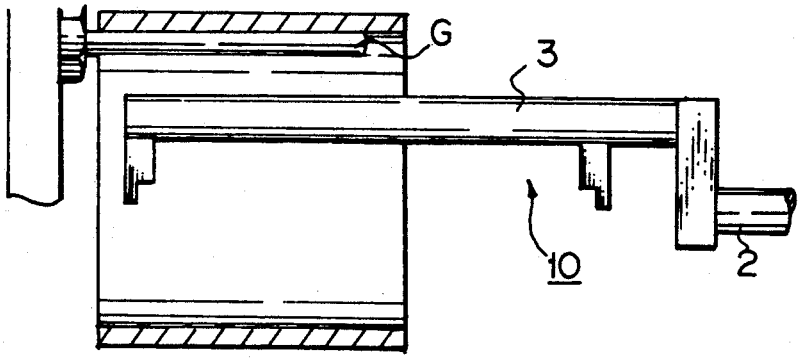

Use in practice of the package holder in accordance with the present invention will now be also explained in reference to FIGS. 9A to 9C, in which a bobbin B is to be transferred between the package holder 10 and a peg G on a creel.

Figure 10:
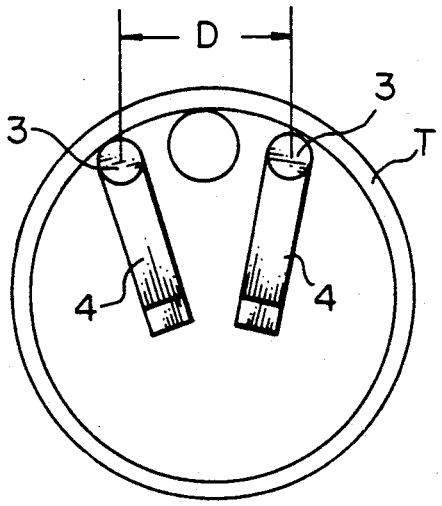
FIG. 10 is an end view of the package holder in accordance with the present invention in a condition holding a bobbin.

First, as shown in FIG. 9A, the package holder travels towards a peg G whilst holding a bobbin B via its tube T with its support shaft 3. By further travel of the package holder, the peg G invade into the interior of the tube T as shown in FIG. 9B. The relation in position between the support shafts 3 and the peg G is illustrated in FIG. 10. After complete invasion of the peg G into the tube T, the package holder 10 moved downwards as shown in FIG. 9C and the bobbin is completely transferred to the peg G on the creel. In order to avoid undesirable interference during this movement between the support shaft 3 and the peg G, the distance D between the pair of support shafts 3 is set greater than the diameter of the peg G.

When the package holder in accordance with the present invention is used in exchange of packages, a simple 180 degree rotation enables the package holder to handle both a pan and a bobbin without any additional change in design, thereby greatly reducing loss in production efficiency.

We claim:

1. Method for exchanging packages on a textile machine in which an assistant device for displacing said packages in a substantially horizontal position, a package supporter equipped with a support frame which is provided with a number of pegs and rotatable about a vertical axis, and at least one creel loader reciprocal between a creel and said package supporter are used in combination, said method comprising the steps of transferring empty packages from said creel to said creel loader, transporting said empty packages to the position of said package supporter by travel of said creel loader, transferring said empty packages from said creel loader to said package supporter, rotating said package supporter about said vertical axis over 180 degrees to place full packages thereon in position facing said creel loader, transferring said full packages from said package supporter to said creel loader, transporting said full packages to the position of said creel by travel of said creel loader, transferring said full packages from said creel loader to said creel, dismounting said empty packages from said package supporter by operation of said assistant device during transportation and transfer of said full packages, and mounting new full packages from a package stocker to said package supporter.

* * * * *